United States Patent [19]

White

[11] 4,431,892

[45] Feb. 14, 1984

[54] VENTILATED MODULAR COOKTOP CARTRIDGE

[75] Inventor: Donald A. White, Indianapolis, Ind.

[73] Assignee: Jenn-Air Corporation, Indianapolis, Ind.

[21] Appl. No.: 284,283

[22] Filed: Jul. 17, 1981

[51] Int. Cl.[3] ..... H05B 6/12; F24C 15/10

[52] U.S. Cl. ..... 219/10.49 R; 219/10.67; 219/447; 219/460; 219/463; 126/37 A; 126/39 K; 126/299 D; 99/340

[58] Field of Search ..... 219/10.49 R, 10.67, 219/10.75, 444, 460, 462, 463, 400, 447; 126/37 R, 37 A, 39 H, 39 N, 39 J, 39 K, 299 R, 299 D; 99/DIG. 14, 340

[56] References Cited

U.S. PATENT DOCUMENTS

| | | | |
|---|---|---|---|
| 3,474,724 | 10/1969 | Jenn | 219/400 X |
| 3,797,375 | 3/1974 | Cerola | 219/460 X |
| 3,838,505 | 10/1974 | Doner | 219/463 X |
| 4,042,806 | 8/1977 | McCartney | 219/460 X |
| 4,191,875 | 3/1980 | Cunningham | 219/10.49 R |
| 4,236,503 | 12/1980 | Kemp | 126/39 K X |

FOREIGN PATENT DOCUMENTS

| | | | |
|---|---|---|---|
| 54-13036 | 1/1979 | Japan | 219/10.49 R |

*Primary Examiner*—B. A. Reynolds
*Assistant Examiner*—Philip H. Leung
*Attorney, Agent, or Firm*—Richard L. Ward

[57] ABSTRACT

The electronic components in the cavity of a modular induction cooktop cartridge are cooled as a result of ventilation provided by a proximity ventilation system. The cooktop cartridge is raised relative to the surface of the range and ports are provided on opposite sides of the cartridge in the raised portion whereby the proximity ventilation system educts air from the cavity and thereby causes an air circulation path through the cavity.

11 Claims, 12 Drawing Figures

VENTILATED MODULAR COOKTOP CARTRIDGE

BACKGROUND OF THE INVENTION

Magnetic induction heating is based upon transformer theory. Basically, a coil is located beneath the cooktop surface and is used to generate an oscillating, circular magnetic field. When an iron-based pot or pan is placed in the magnetic field, it acts as a shorted transformer secondary which is subject to a high induction current at low voltage. The cookware heats up and cooks its contents in the same manner as conventional ranges and cooktops. It is, however, the heat from the utensil that cooks the food, not the induction field, since heat is generated in the utensil which itself becomes the burner. The utensil will in turn heat the surface on which it is located but the area surrounding the utensil will remain cool.

The circuitry for a magnetic induction unit includes the induction coil which is generally of a flat, spiral configuration. An inverter is used to generate an oscillatory magnetic field in the 25–30 kHz range and, because of the fast switching, a semiconductor is used as the inverter switch. Since the inverter can be supplying 15 amperes at 30 kHz, it is necessary to cool the circuitry to prevent overheating of the components. In some ranges forced ventilation is present and may be used to cool the circuitry as well as to perform its other functions. In a convertible cooktop range, even those with a proximity ventilation system (i.e. where the range structure is combined with an exhaust system in proximity to the cooking surface), there is no provision for the internal cooling or ventilating of a cooktop cartridge, and therefore, such systems have not heretofore been designed or intended to have such a function. Their basic function has been to capture cooking fumes from utensils, grills or other cooking accessories at a point near the cooking surface and to direct these to the outdoors or through a filter with the capacity and ability to have a cleaning effect on the soiled air before returning it to the environment of the range.

SUMMARY OF THE INVENTION

The present invention is directed to apparatus for ventilating a cooktop cartridge interior such as that of a modular induction cooktop cartridge. More specifically, the present invention is directed to a cooktop cartridge adapted to be provided with a cooling airflow by means of an existing proximity ventilation system which is also utilized in the capture of cooking fumes.

Basically, the present invention provides a modular cooktop cartridge having a raised surface to provide more room within the cartridge as well as to raise the cooktop with respect to a proximity ventilation system so as to be ventilated thereby. Inlet/outlet openings are provided at least at the side or end of the raised surface which is nearest the location of a proximity ventilation system, when installed, as well as in the opposite side or end to provide cross ventilation and to make the cartridge optionally right or left handed, as desired. Internal vanes or the like can be provided internally of the cartridge so as to achieve a desired airflow. Various grilles are provided which can be used to connect the proximity ventilation system to the inlet/outlet openings in order to maximize the cooling air circulating through the cartridge.

It is an object of this invention to provide a modular cooktop cartridge which can be internally cooled by a conventional proximity ventilation system.

It is another object of this invention to provide a modular cooktop cartridge suitable for an induction unit which has an internal cooling requirement.

It is a further object of this invention to provide a convertible cooktop cartridge which is externally vented and which will operatively coact with a built-in-ventilation system in any location on the range which will accept a cartridge. These objects, and others as will become apparent hereinafter, are accomplished by the present invention.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
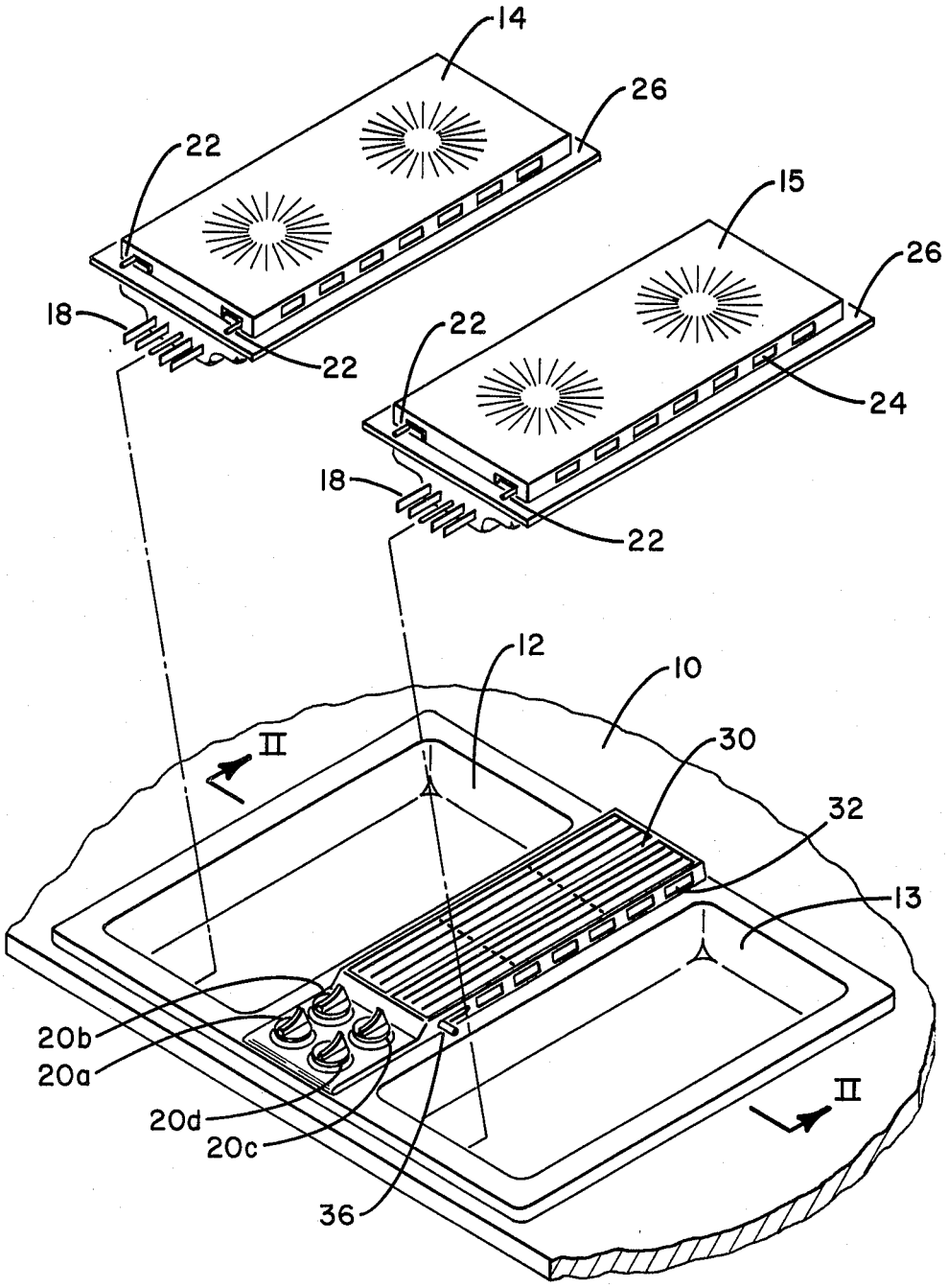
FIG. 1 is a partial, exploded view of a range employing two cooktop cartridges made according to the present invention.
Figure 2:
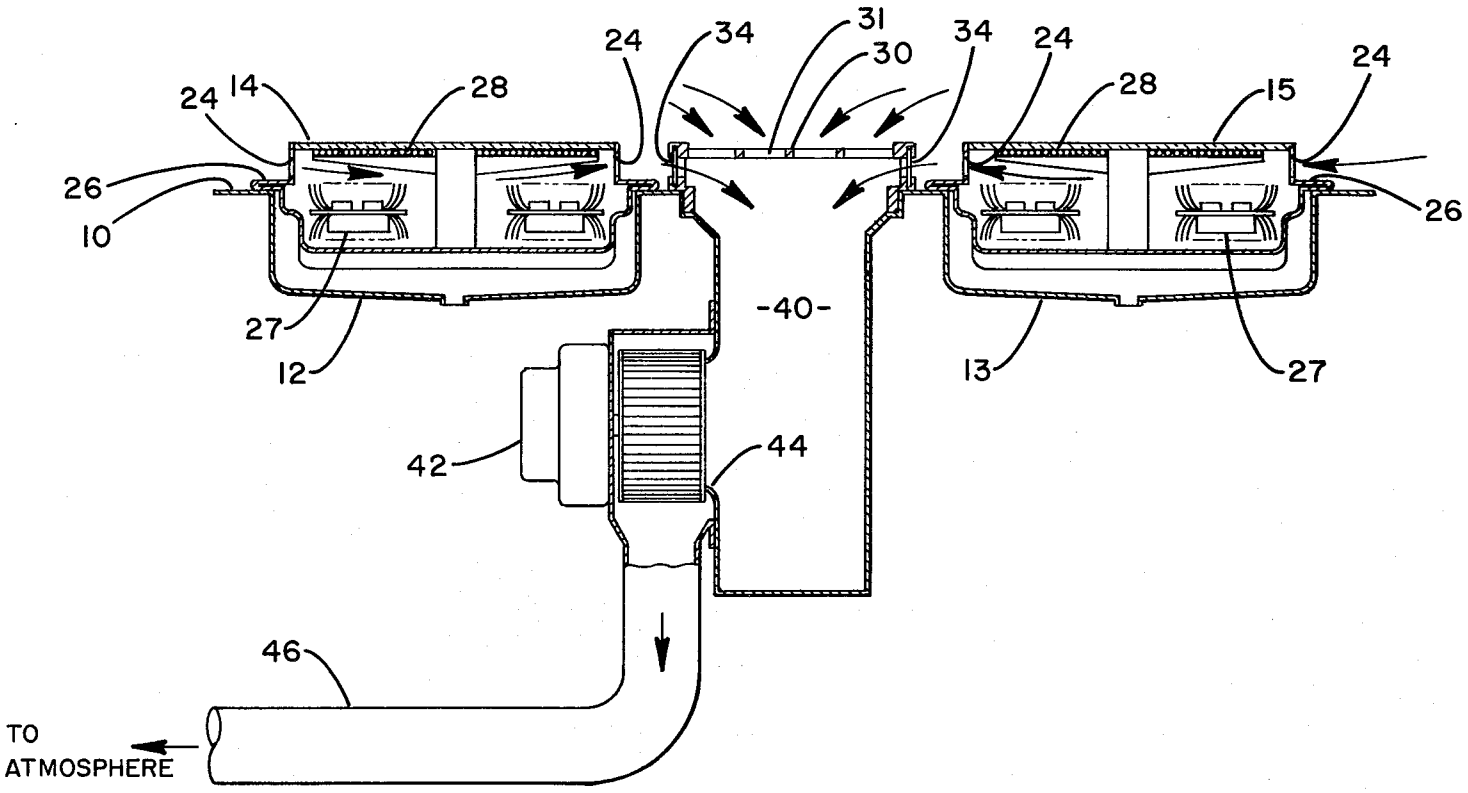
FIG. 2 is a sectional view taken along line II—II of FIG. 1.
Figure 3:
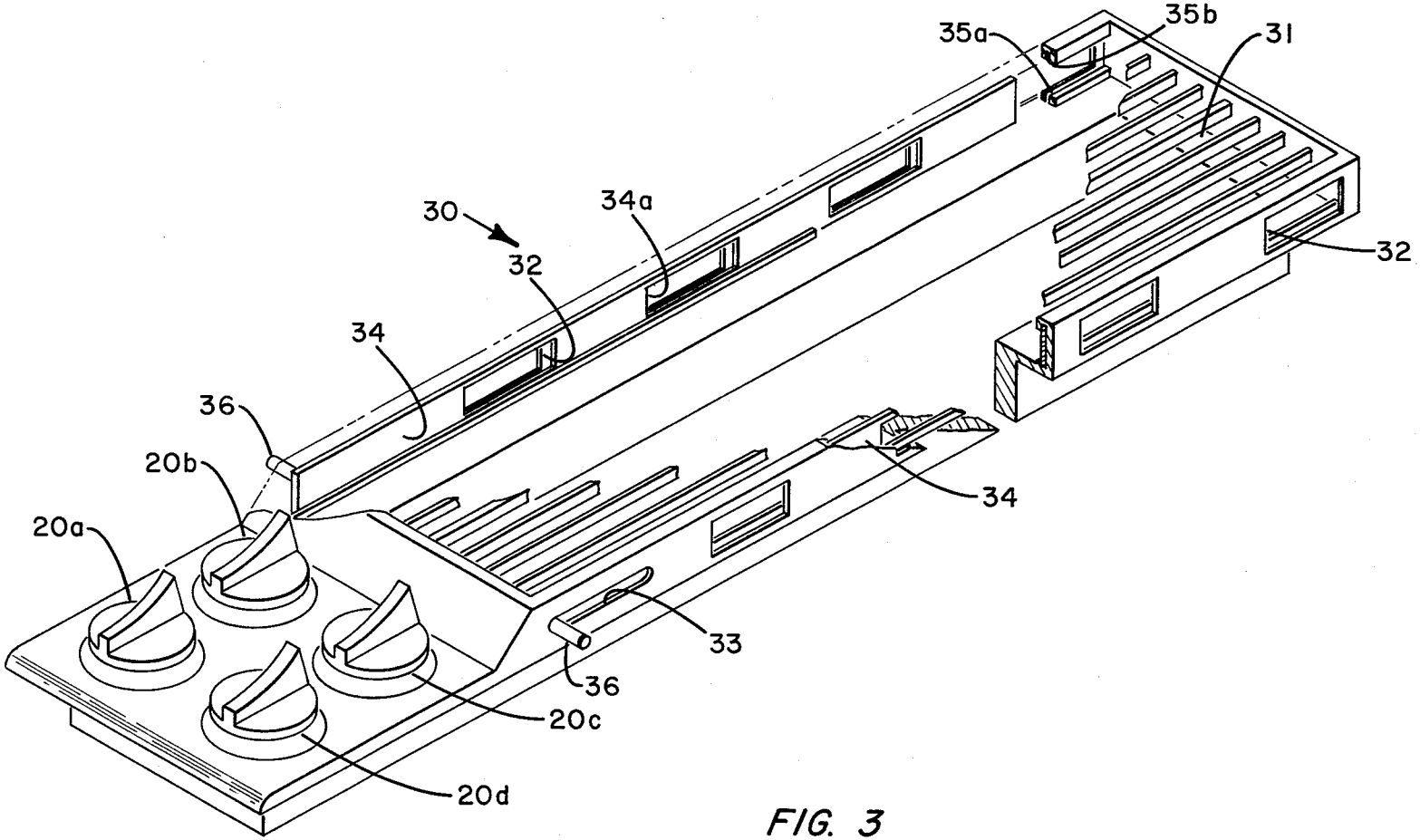
FIG. 3 is a partially cut away view of the grille of FIG. 1.

In FIGS. 1–3, the numeral 10 designates the upper surface of a range (either a free-standing range or counter drop-in type) provided with pan-like sheet metal recess means or grille pans 12 and 13 for selectively receiving cooking apparatus of various types with identical induction cooktop cartridges 14 and 15, each containing two induction units, being illustrated. Each of the cooking units for use with range 10 is provided with a bayonet-type terminal 18 which is adapted to be removably received in an electrical outlet means (not illustrated) provided in the front wall of each recess means 12 and 13. Control of the cooktop cartridges is generally achieved by means of controls 20*a–d*, but, for induction cartridges 14 and 15, the controls serve as on-off controls with individual regulation of the induction units being achieved by means of infinitely variable slide resistors 22 which are in the circuits of the induction units.

As best shown in FIG. 2, induction cooktop cartridges 14 and 15, unlike other cooktop cartridges, extend above the surface of range 10 and have a plurality of ports 24 located above the surface of range 10. The cartridges 14 and 15 each have a peripheral flange 26 which rests on the portion of the surface of range 10 surrounding metal recesses 12 and 13, respectively, so as to be essentially coplanar therewith. Grille 30 is located at the entrance to air plenum chamber 40. A power driven exhaust fan 42 is located adjacent exhaust opening 44 of plenum 40. Air, as indicated by arrows, is drawn from across induction cooking cartridges 14 and 15 and through grille 30 into the plenum 40 thence to exhaust fan 42 and atmosphere via line 46. This function is known and serves to remove heated air, smoke and odoriferous cooking gases from the cooking area. However, because induction cooking cartridges 14 and 15 are raised with respect to the surface of range 10, the ports 24 nearest grille 30 are subject to an educting action by exhaust fan 42. As a result, ambient air is drawn into the interior of cartridges 14 and 15 through outer ports 24 and passes over the electronic components 27 which control induction coil 28 and thereby serves to cool the components 27. The air then passes through the inner ports 24 through grille 30 and fan 42 to atmosphere.

Referring now to FIG. 3, the grille 30 has a plurality of openings 31 in its upper surface and these openings 31 form a part of the normal flow path for the proximity ventilation system, as is well known. While the flow path through the openings 31 will provide some educting action relative to the interiors of cartridges 14 and 15, a larger volume flow through the cartridges is generally desired. To achieve a greater educting action, openings 32 are provided on opposite sides of the grille 30. A slide valve 34 is located on each side of the grille 30 and coacts with associated openings 32. Each of the slide valves 34 is slidably received in guide slots 35*a* and *b* and is movable by means of a knob 36 which extends through a slot 33 in the side of grille 30. Ordinarily, the slide valves 34 will be fully open (aperatures 34*a* in alignment with openings 32 and ports 24) or closed (slide valve 34 covering openings 32) depending upon the cooking units being used. The open position of valve(s) 34 will normally correspond to the use of an induction cartridge 14 and/or 15.

The operation of the range 10 of FIGS. 1–3 will be essentially that of a standard proximity ventilation system when slide valves 34 are closed. Specifically, air, together with smoke and cooking fumes, will be drawn into openings 31 of grille 30 and will serially pass through plenum 40, exhaust fan 42 and line 46 to atmosphere. When an induction cartridge 14, 15 is being used, even if the corresponding slide valve 34 is closed, an eduction action will take place whereby air will be educted from the interior of cartridge 14, 15 via the ports 24 which are closest to grille 30. As a result, makeup air enters the interior of cartridge 14, 15 via the ports 24 which are furthest from grille 30 and a ventilating air flow is thereby established through the cartridge 14, 15. The opening of the corresponding slide valve 34 establishes a straight-line flow path between the ports 24 nearst grille 30 and openings 32 in the side of grille 30 to establish a stronger ventilating air flow through the cartridge 14, 15. The concurrent uses of cartridges 14 and 15 and the opening of both slide valves 34 would produce the described ventilating flow in both induction cartridges. Whether or not slide valves 34 are open, a sufficient proximity ventilation function will take place, but with slide valve(s) 34 open and induction cartridge 14 and/or 15 in operation a sufficient ventilating flow will additionally occur in the cartridges to keep the electronic components 27 cooled. The enabling of the range 10 will be by means of controls 20*a–d* which are interlocked with proximity ventilation system. However, where an induction cartridge 14 or 15 is being used, the appropriate control 20*a–d* is put in the "high" position and the induction unit is regulated by means of infinitely variable slide resistor 22 located on the cartridge, as illustrated, or located in the range 10.

Figure 4:
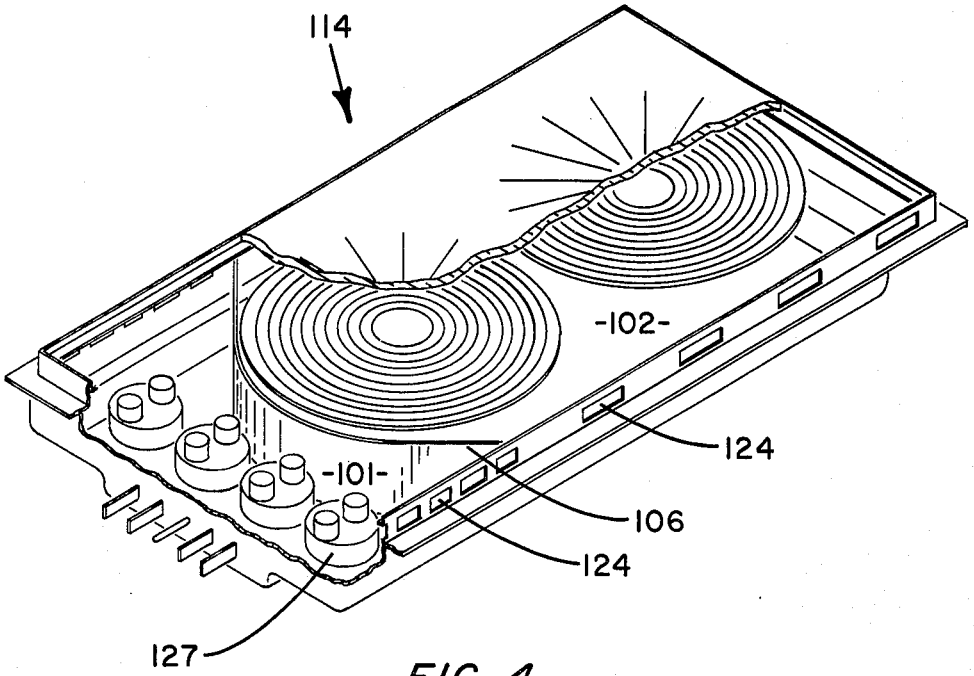
FIG. 4 is a partially cut away view of a modified cartridge.
Figure 5:
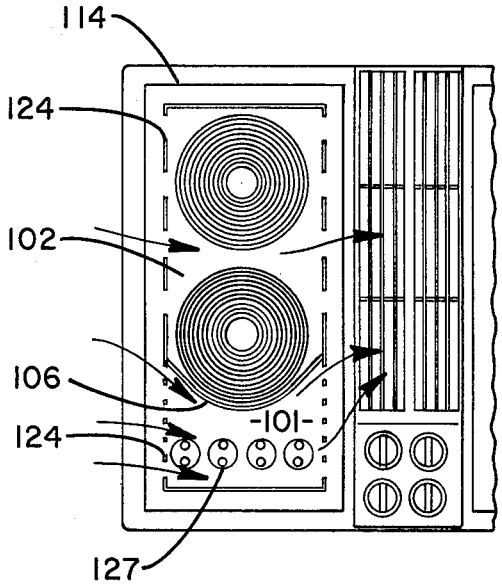
FIG. 5 is a top view of the modified cartridge of FIG. 4 with the top removed.

In an induction cartridge, the components most vulnerable to overheating are the inverter switches which are in the form of transistors mounted on a heat sink. Because of this differential cooling requirement, the cooling function can be localized or apportioned by the use of vanes and/or baffles to cause the internal air flow in the cartridge to be as desired or required. Referring now to FIGS. 4 and 5, a modified induction cartridge 114 is shown in which a vane or baffle 106 partitions the cavity of induction cartridge 114 into two portions 101 and 102, respectively. The vane or baffle 106 divides the cartridge cavity such that portion 102 is larger than portion 101 but portion 101 is in communication with a larger portion of inlet/outlet ports 124 whereby more cooling flow will take place in portion 101 which contains the electronic circuitry 127, or at least those portions most subject to heat damage. The ports 124 are illustrated as being of different sizes and spacing for portions 101 and 102 but the size, number and spacing of the ports is a design choice. Except for the apportioned flow the cartridge 114 will function the same as cartridges 14 and 15 of FIGS. 1–3.

Figure 7:
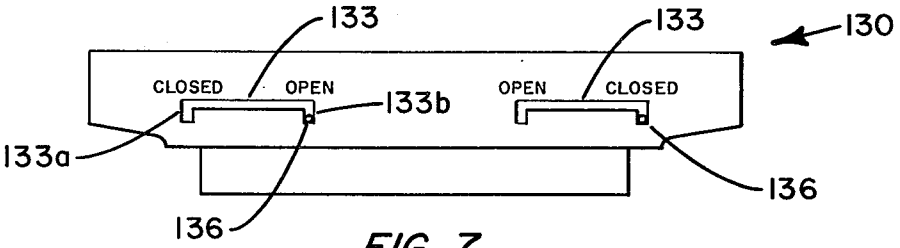
FIG. 7 is an end view of the modified grille of FIG. 6.
Figure 8:
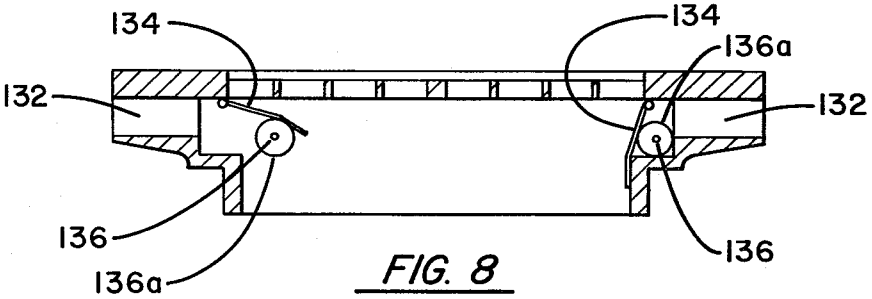
FIG. 8 is a sectional view taken along line VIII—VIII of FIG. 6.
Figure 6:
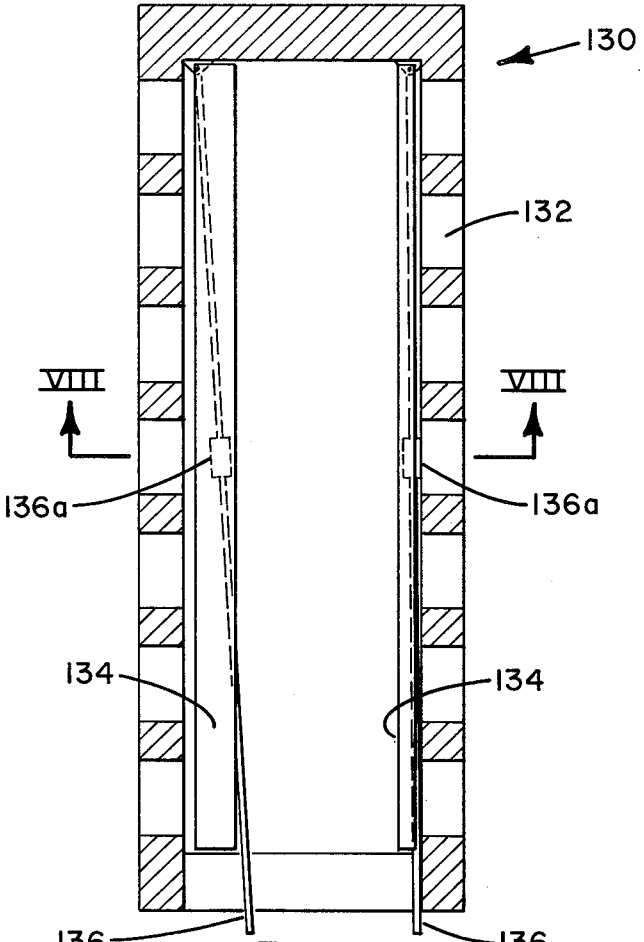
FIG. 6 is a top sectional view of a modified grille.

In the grille 130 of FIGS. 6–8, pivoted valves 134 are provided for controlling the flow of air into the plenum via openings 132. Rods 136 are pivoted at the back of grille 130 and can be moved in slots 133 at the front of the grille 130 between closed position 133*a* and open position 133*b*. In FIGS. 6–8 the pivoted valves 134 on the left and right sides of the drawings are illustrated in the open and closed positions, respectively. Discs 136*a* which are located on rods 136 engage the pivoted valves 134 to move them to the open position to establish the flow path between openings 132 and the plenum. The operation of grille 130 would be the same as that of grille 30 except for the difference in valve actuation.

The devices of FIGS. 1–3 and 6–8 are provided with permanent grilles 30, 130 in which valves 34, 134 are used to convert the grilles from conventional operation to selectively, additionally provide a ventilation flow through induction cartridges by opening the side openings 32, 132 in the grilles 30, 130. Alternatively, the grilles can be made interchangeable so that a specially designed grille can be installed whenever an induction cartridge is to be used.

Figure 9:
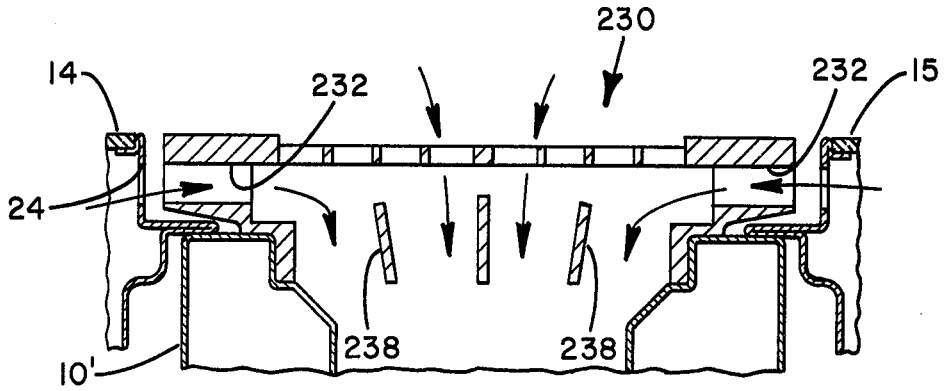
FIG. 9 is a sectional view of a second modified grille.

In FIG. 9, the grille 230 is interchangeable and may be snapped in and out of range 10′, as desired. Grille 230 extends sideways so that the openings 232 in the sides of grille 230 closely made with the corresponding ports 24 on the side of the induction cartridges 14 and 15. Internal vanes 238 are provided in grille 230 so that a greater portion of air can be drawn through the openings 232 in the side of the grille 230 and thereby a greater air flow through the induction cartridges 14 and 15.

Figure 10:
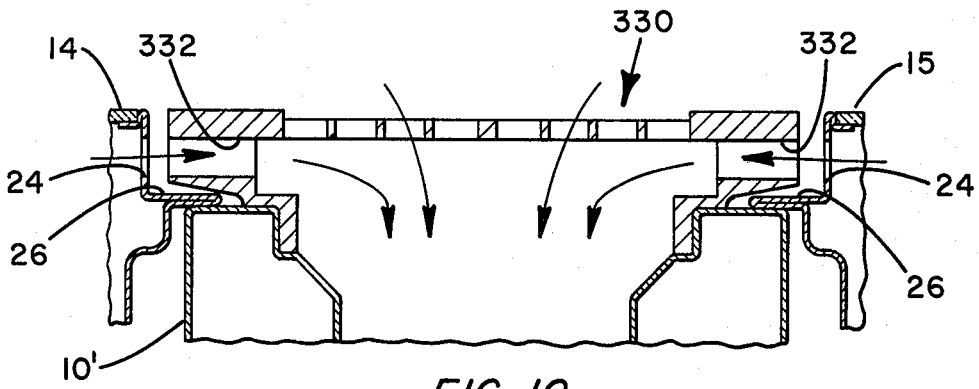
FIG. 10 is a sectional view of a third modified grille.

Referring now to FIG. 10, grille 330 is interchangeable and may be snapped in and out of the range 10′, as desired. Grille 330 extends sideways so that the openings 332 in the sides of the grille 330 are close to matching ports 24 of the induction cartridges 14 and 15. Because the grille 330 extends sideways, it overlies the flange 26 of induction cartridges 14 and 15. As a result, the grille 330 must be removed to permit insertion and removal of the induction cartridges 14 and 15. Although grille 330 could be used with cartridges other than induction cartridges, ordinarily such cartridges are flush with the surface of the range and a separate snap in grille (not illustrated) of normal construction would be used with such cartridges.

Figure 11:
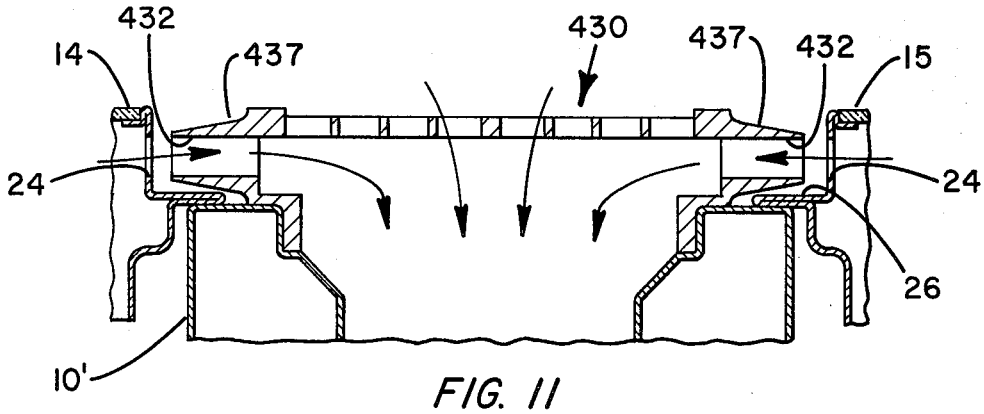
FIG. 11 is a sectional view of a fourth modified grille.

In FIG. 11, grille 430 is interchangeable and may be snapped in and out of the range 10', as desired. Grille 430 has extensions 437 located on the sides and terminating in openings 432 which closely mate with the ports 24 on the adjacent sides of induction cartridges 14 and 15. The extensions 437 overlie the flanges 26 of the cartridges 14 and 15 and therefore the grille 430 must be removed to install or remove a cartridge.

Figure 12:
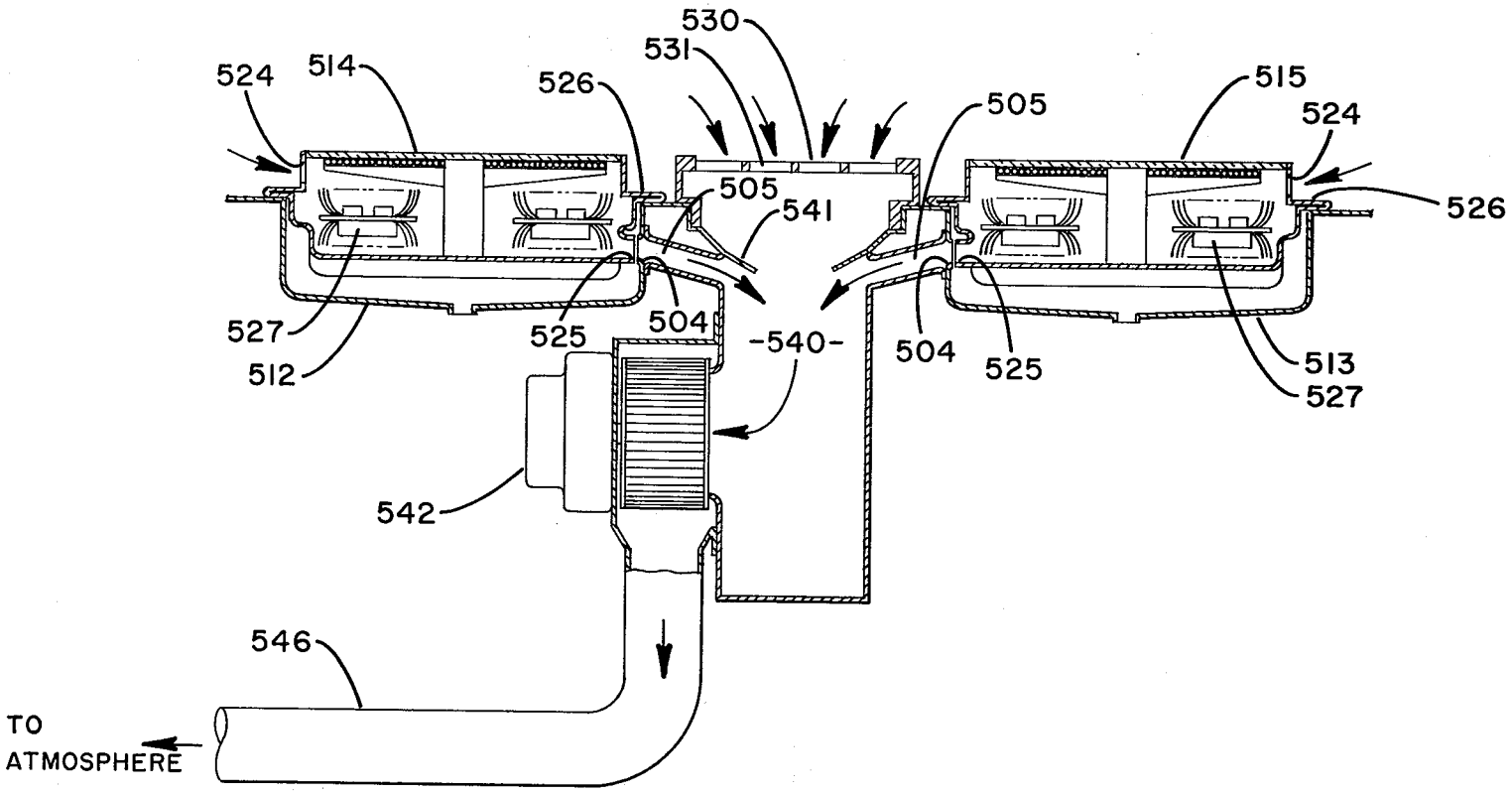
FIG. 12 is a sectional view of a range with a modified proximity induction system.

Referring now to FIG. 12, the ventilation flow through the induction cartridges 514 and 515 can be directly to the plenum 540 from the interior of the cartridges 514 and 515 without passing through the grille 530 and necessarily through the open atmosphere. To achieve this direct flow, ports 525 are formed in the sides of induction cartridges 514 and 515 nearest the proximity ventilation system, when installed, and at a location below flange 526 so that ports 525 are located within the sheet metal recess or grille pans 512 and 513. Apertures 504 are formed in the walls of pans 512 and 513 nearest the proximity ventilation system and in mating relationship with the ports 525 of the cartridges 514 and 515, when installed. Apertures 504 communicate via passages 505 with the air plenum chamber 540 at a point down stream of vanes or baffles 541 and upstream of exhaust fan 542. Ports 524 are located in cartridges 514 and 515 at a point above flange 526 and, preferably, only on the side of the cartridges opposite ports 525. It should be noted that ports 524 and 525 make the induction cartridges 514 and 515 asymmetrical and therefore not interchangeable as was the case of the cartridges 14 and 15 of the FIG. 1–3 device.

The operation of FIG. 12 system will be essentially that of the system of FIGS. 1–3 but for the specific details of ventilating flow path through the cartridges 514 and 515. As is conventional, exhaust fan 542 draws heated air, smoke and odoriferous cooking gases from the cooking area through openings 531 of grille 530 into the plenum chamber 540 and thence through the fan 542 to atmosphere via line 546. Additionally, air is educted from the interiors of cartridges 514 and 515 via ports 525, apertures 504 and passages 505 into the plenum chamber 540 from whence it is exhausted with the heated air, smoke and cooking gases. The eduction flow is enhanced by the presence of vanes or baffles 541 so that a ventilating and cooking air flow is established by air flowing into the cartridges 514 and 515 via ports 524 and flowing through the cartridges 514 and 515 to thereby cool the electronic components 527. The air passes from the cartridges 514 and 515 via ports 525 and passes through apertures 504 and passages 505 into the plenum 540 and is exhausted to atmosphere. If a conventional, non induction, cartridge is used in the system of FIG. 12, the absence of ports 524 and 525 will essentially cut off the source of atmospheric air and the ventilating flow will only be in the nature of leakage flow. However, apertures 504 may be closed with valves or plugs if necessary, or desired, when an induction cartridge is not being used.

Although the present invention has been specifically described in terms of a system capable of employing two induction cartridges with a proximity ventilation system therebetween, it should be obvious to those skilled in the art that a single induction cartridge can be used with suitable modification of the grilles of FIGS. 3 and 6–11. Similarly, the proximity ventilation in such a case can be located in the front or back of the cartridge as well as at the side. Also, only the portion of the cartridge caavity containing the electronic components, or the most heat sensitive components, may be ventilated.

Thus, although preferred embodiments of the present invention have been illustrated and described, other changes will occur to those skilled in the art and it is therefore intended that the scope of the present invention is to be limited only by the scope of the appended claims.

What is claimed is:

1. A cooking range for selectively receiving cooking cartridge means comprising:

housing means having at least one pan-like member forming a recess;

proximity ventilation means in said housing means having an inlet opening adjacent to the opening of said recess;

cooking cartridge means defining a cavity containing heat producing means therein and adapted to be releasably mounted in said recess; a flange on said cartridge means adapted to coact with said housing means to support said cartridge means so that said cartridge means is partially received in said recess;

wall means on said cartridge extending above a plane defined by said flange which is essentially coplanar with the opening of said recess;

a first set of airflow ports on one side of said cartridge means and a second set of airflow ports on another side of said cartridge means opposite said one side with said first set of airflow ports being located in said wall means above said flange and defining air inlet means into said cavity and said second set of airflow ports being adjacent said proximity ventilation means when said cartridge means is releasably mounted in said recess and defining air outlet means, said proximity ventilation means being operable for educting air from said cavity into said proximity ventilation means through said air outlet means thereby causing ambient air to be drawn into said cavity through said air inlet means so that air circulation is established through said cavity and whereby said heat producing means are cooled by airflow induced exteriorly of said cartridge means.

2. The cooking range as claimed in claim 1 wherein said cooking cartridge means is a modular induction cooktop cartridge and said heat producing means are electronic components controlling an induction coil.

3. The cooking range as claimed in claim 2 further including flow directing means in said cavity coacting with said first and second set of airflow ports to define at least one flow path through said cavity whereby the air circulation is directed to those portions of the cavity containing said heat producing means.

4. The cooking range as claimed in claim 1 wherein said proximity ventilation means includes a grille having openings in the side thereof corresponding to said second set of airflow ports and forming a part of the flow path for the eduction flow.

5. The cooking range as claimed in claim 4 wherein said openings in said grille are valved.

6. The cooking range as claimed in claim 4 wherein said housing means includes a second pan-like member and a second cooking cartridge means as previously defined and said grille has openings in the side thereof corresponding to the second set of airflow ports of said second cartridge means.

7. The cooking range as claimed in claim 1 wherein apertures are formed in said pan-like member adjacent said second set of airflow ports and communicate with said proximity ventilation system through a closed path in said housing means.

8. A cooking range comprising:

housing means forming a recess for selectively receiving cooking cartridge means;

proximity ventilation means operably associated with said housing means and having an inlet opening adjacent to said recess and operable for drawing air into said inlet opening;

cartridge enclosure means defining a cavity containing heat producing means therein and adapted to be releasably mounted in said recess;

a flange on said cartridge enclosure means adapted to support said cartridge enclosure means at least partially in said recess;

upwardly extending side wall portions associated with said cartridge enclosure means and above said flange for extending a portion of said cooking cartridge means substantially above said flange;

a first set of airflow ports in one of said upwardly extending side wall portions of said cartridge enclosure means and defining air inlet means;

a second set of airflow ports in another portion of said cartridge enclosure means generally opposite said first set of airflow ports and defining air outlet means;

whereby air passing by said air outlet means as induced by said proximity ventilation means will cause air to be educted from said cavity through said air outlet means which causes air to be drawn into said cavity through said air inlet means so that air circulation is established through said cavity and said heat producing means may be cooled by airflow induced exteriorly of said cooking cartridge means.

9. The cooking range of claim 8 further including flow directing partition means in said cavity to apportion air circulation within said cavity.

10. The cooking range of claim 8 wherein said second set of airflow ports is located below said flange.

11. A cooking range for selectively receiving cooking cartridge means comprising:

housing means having at least one pan-like member forming a recess;

proximity ventilation means operably associated with said housing means and including grille means having generally upwardly facing primary air intake openings and secondary air inlet openings located in a side portion;

cooking cartridge means including structure defining a cavity for containing heat producing means and adapted to be releasably mounted in said recess, said cooking cartridge means further including a peripheral flange adapted to coact with said housing means for supporting said cooking cartridge means so that a first portion is received in said recess and a second portion extends above a plane defined by said flange which is essentially coplanar with the opening of said recess, said second portion of said cooking cartridge means including side wall portions extending upwardly above the plane of said flange;

and a first set of airflow ports in one of said upwardly extending side walls defining air inlet means into said cavity and a second set of airflow ports in another upwardly extending side wall opposite the first set of airflow ports defining air outlet means from said cavity, said air outlet means located in closely spaced juxtaposition to said secondary air inlet openings in said grille means, said proximity ventilation means being operable for educting air from said cavity through said air outlet means and into said proximity ventilation means through said secondary air inlet openings of said grille means thereby causing ambient air to be drawn into said cavity through said air inlet means so that air circulation is established through said cavity and wherein cooling of said heat producing means is effected by an airflow induced exteriorly of said cartridge means.

* * * * *